US010925371B2

(12) United States Patent
Hein

(10) Patent No.: US 10,925,371 B2
(45) Date of Patent: Feb. 23, 2021

(54) HAIR BRUSH

(71) Applicant: CONAIR CORPORATION, Stamford, CT (US)

(72) Inventor: Duane Charles Hein, Monroe, CT (US)

(73) Assignee: Conair Corporation, Stamford, CT (US)

( * ) Notice: Subject to any disclaimer, the term of this patent is extended or adjusted under 35 U.S.C. 154(b) by 279 days.

(21) Appl. No.: 15/820,044

(22) Filed: Nov. 21, 2017

(65) Prior Publication Data

US 2019/0150583 A1 May 23, 2019

(51) Int. Cl.

| | |
|---|---|
| ***A45D 2/00*** | (2006.01) |
| ***A45D 24/16*** | (2006.01) |
| ***A45D 1/18*** | (2006.01) |
| ***A45D 1/06*** | (2006.01) |
| ***A46B 5/00*** | (2006.01) |

(Continued)

(52) U.S. Cl.

CPC ..... *A45D 24/16* (2013.01); *A45D 1/06* (2013.01); *A45D 1/18* (2013.01); *A45D 2/002* (2013.01); *A46B 5/002* (2013.01); *A46B 9/023* (2013.01); *A46B 9/06* (2013.01); *A46B 15/0016* (2013.01); *A46B 15/0059* (2013.01); *A45D 7/02* (2013.01); *A46B 2200/104* (2013.01)

(58) Field of Classification Search

CPC . A45D 24/16; A45D 1/06; A45D 1/18; A45D 1/00; A45D 1/04; A45D 1/08; A45D 1/14; A45D 1/16; A45D 2/002; A45D 2/00; A45D 7/02; A45D 2002/007; A45D 24/04; A45D 24/06; A46B 5/002; A46B 9/023; A46B 15/0016; A46B 15/0059; A46B 2200/104

USPC ..... 132/120, 232, 118, 212; 15/160, 207.2, 15/187, 27; 219/222, 225, 533

See application file for complete search history.

(56) References Cited

U.S. PATENT DOCUMENTS 1,572,399 A * 2/1926 Lewis ..... A45D 1/18 132/136

3,935,423 A 1/1976 Pucci (Continued)

FOREIGN PATENT DOCUMENTS

KR 101240183 10/2011

OTHER PUBLICATIONS

English Abstract of KR101240183.

*Primary Examiner* — Rachel R Steitz

(74) *Attorney, Agent, or Firm* — Lawrence Cruz, Esq.; Ryan, Mason & Lewis, LLP

(57) ABSTRACT

A hair brush adapted to impart both a straightening effect and a curling effect on a length of hair includes first and second members. The first member includes a first handle and a first brush head having an inner row of centrally disposed primary teeth, an outer row of bristles mounted on each side of the centrally disposed primary teeth, and a thermal conductive element. The thermal conductive element defines an arcuate surface configured for imparting a curl within a lock of hair. The second member includes a second handle, a second brush head having a second head frame defining a longitudinal channel, and an elongate member having a wiper segment disposed on each side of the longitudinal channel, and configured to engage the length of hair to facilitate one of straightening of the length of hair or removing substances from the length of hair.

13 Claims, 8 Drawing Sheets

(51) Int. Cl.

| | |
|---|---|
| ***A46B 15/00*** | (2006.01) |
| ***A46B 9/02*** | (2006.01) |
| ***A46B 9/06*** | (2006.01) |
| *A45D 7/02* | (2006.01) |

(56) References Cited

U.S. PATENT DOCUMENTS

| | | | | |
|---|---|---|---|---|
| 5,799,671 | A * | 9/1998 | Takimae | A45D 2/002 132/118 |
| 5,979,463 | A | 11/1999 | Santy, III et al. | |
| 6,070,596 | A * | 6/2000 | Altamore | A45D 1/04 132/224 |
| 6,341,611 | B1 | 1/2002 | Nakamura | |
| 6,817,053 | B2 | 11/2004 | Nakamura | |
| 7,310,849 | B2 | 1/2007 | White et al. | |
| 7,478,640 | B2 * | 1/2009 | Saida | A45D 1/04 132/228 |
| 7,490,615 | B2 * | 2/2009 | Rizzuto | A45D 2/002 132/129 |
| 7,650,893 | B2 * | 1/2010 | De Laforcade | A45D 19/02 132/218 |
| 7,661,174 | B2 | 2/2010 | Park | |
| 7,712,176 | B2 | 5/2010 | Guenin | |
| 8,196,592 | B2 | 6/2012 | Choi | |
| 8,220,100 | B2 * | 7/2012 | Diamond | A46B 5/0012 132/132 |
| 8,230,868 | B2 * | 7/2012 | Choi | A45D 1/04 132/224 |
| 8,267,098 | B2 | 9/2012 | Glucksman | |
| 8,342,188 | B2 | 1/2013 | Pabari et al. | |
| 8,397,336 | B2 | 3/2013 | Park | |
| 8,919,350 | B1 | 12/2014 | Hsu | |
| 9,326,591 | B2 | 5/2016 | Smal | |
| 9,402,460 | B2 | 8/2016 | Hickey | |
| 9,578,943 | B2 | 2/2017 | Guy-Rabi et al. | |
| 9,591,906 | B2 | 3/2017 | Guy-Rabi et al. | |
| 2004/0250831 | A1 * | 12/2004 | Rizzuto | A45D 2/002 132/271 |
| 2007/0033754 | A1 | 2/2007 | Diamond | |
| 2007/0174984 | A1 * | 8/2007 | Diamond | A45D 20/525 15/106 |
| 2008/0223387 | A1 * | 9/2008 | Julemont | A45D 2/002 132/118 |
| 2011/0220141 | A1 | 9/2011 | Chan | |
| 2013/0199561 | A1 * | 8/2013 | Schlough | A45D 1/16 132/211 |
| 2015/0122286 | A1 * | 5/2015 | Valle | A45D 1/04 132/229 |
| 2016/0022022 | A1 | 1/2016 | Lorenzi et al. | |
| 2017/0188681 | A1 * | 7/2017 | Leung | A45D 2/001 |
| 2017/0208915 | A1 * | 7/2017 | Richmond | A45D 20/12 |

* cited by examiner

HAIR BRUSH

BACKGROUND

1. Technical Field

The present disclosure relates to a hair brush, and, in particular, relates to a hair brush adapted for imparting both a straightening effect and a curling effect on a length of hair.

2. Discussion of Related Art

Hair brushes or combs for either straightening or curling a length of hair are known in the art. A typical "straightener brush" includes a pair of brush heads which are movable to trap a length of hair therebetween. With the application of heat, the opposing planar surfaces of the brush heads cooperate to straighten the length of hair. A typical "curling brush" may incorporate brush heads with curved inner surfaces whereby the hair engaged therebetween generally assumes the curved characteristic of the inner surfaces.

SUMMARY

Accordingly, the present disclosure is directed to further improvements in hair brushes and styling of hair. In general, the hair brush of the present disclosure is adapted to impart both a straightening effect and a curling effect on a length of hair depending on the selected use by the user. In one exemplary embodiment, a hair brush includes first and second members defining a longitudinal axis and configured for relative movement between open and approximated conditions. The first member includes a first handle and a first brush head depending from the first handle. The first brush head has a first head frame, an inner row of centrally disposed primary teeth mounted to the first head frame and extending along the longitudinal axis, an outer row of bristles mounted to the first head frame and extending along the longitudinal axis on each side of the centrally disposed primary teeth and a thermal conductive element mounted to an outer surface of the first head frame. The thermal conductive element defines an arcuate surface configured for imparting a curl within a length of hair. The second member includes a second handle and a second brush head depending from the second handle. The second brush head has a second head frame defining a longitudinal channel extending therethrough configured to at least partially receive the centrally disposed teeth of the first brush head when the first and second members are in the approximated condition, and an elongate member disposed on each side of the longitudinal channel, and having a wiper segment configured to engage the length of hair to facilitate one of straightening the length of hair or removing substances from the length of hair when the first and second members are in the approximated condition.

In one embodiment, the wiper segment is flexible to conform to the length of hair disposed between the first and second brush heads.

The outer rows of bristles may be disposed outwardly on respective longitudinal sides of the second brush head when the first and second members are in the approximated condition.

In one embodiment, a row of supplemental teeth extends along the longitudinal axis on each side of the centrally disposed teeth. The individual teeth of the row of the supplemental teeth may be disposed between adjacent individual bristles of the row of bristles to define an alternating arrangement of bristles and supplemental teeth along the longitudinal axis.

In an embodiment, the thermal conductive element comprises a metallic material.

The first and second members may be configured for pivotal movement between the open and approximated conditions. The first and second members may be normally biased toward the open condition by a spring member. A lock may be mounted relative to the first and second members. The lock may be movable between a locked position to retain the first and second members in the approximated condition and a release position permitting movement of the first and second members toward the open condition under the influence of the spring member.

The first head frame and the conductive member include respective vent openings for passage of thermal energy. The first head frame may define an internal chamber in fluid communication with the vent openings to store thermal energy.

In an embodiment, the centrally disposed primary teeth of the first brush head each define a first primary dimension along the longitudinal axis and a second primary dimension orthogonal to the longitudinal axis where the second primary dimension is greater than the first primary dimension. Similarly, the supplemental teeth may each define a first supplemental dimension along the longitudinal axis and a second supplemental dimension orthogonal to the longitudinal axis where the second supplemental dimension is greater than the first supplemental dimension.

The hair brush of the present disclosure provides a novel arrangement of teeth and bristles which combs a length of hair into a finite number of hand strands enhancing both straightening and curling of the hair. The hair brush also includes elongate members with wipers advantageously dimensioned to facilitate the hair straightening process while removing oils, moisture etc. from the length of hair. Curling of the hair is effected through a built in conductive member on the backside of the brush readily utilized through simple rotation of the brush handle about its own axis. The hair brush may be used with a heat source such as a portable hand held hair dryer.

Other features of the present disclosure will be appreciated from the following description of same.

BRIEF DESCRIPTION OF THE DRAWINGS

Various embodiments of the present disclosure are described hereinbelow with references to the drawings, wherein.

DETAILED DESCRIPTION

Figure 1:
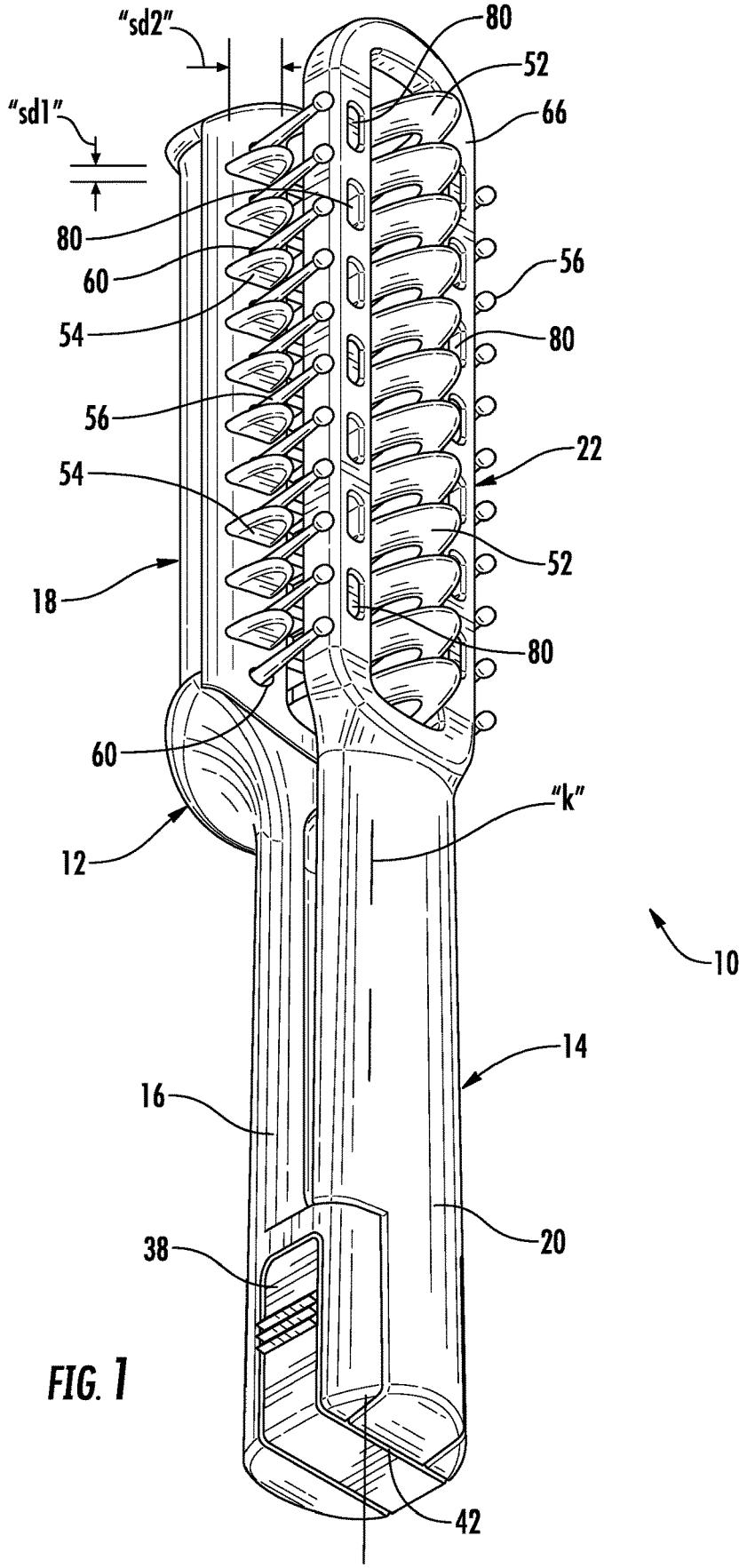
FIG. 1 is a perspective view of the hair brush in accordance with the principles of the present disclosure illustrating the first and second members in a closed condition.

Referring now to the drawing figures wherein like reference numerals identify similar or like components throughout the several views, FIG. 1 illustrates the hair brush in accordance with the principles of the present disclosure. The hair brush is adapted to selectively impart a straightening effect and a curling effect on a length of hair, and incorporates a novel arrangement of teeth and bristles which captures the length of hair and separates the hair into a finite number of strands for treatment. The hair brush also includes a pair of elongate members having wiper segments on one brush head which cooperate with an opposing surface(s) of a second brush head to impart the straightening effect on the length of hair while simultaneously removing moisture, oils, etc. from the hair as the hair brush is pulled through the hair. The hair brush may be utilized with a hair dryer, and incorporates features to capture the thermal energy from the hair dryer and distribute the thermal energy to the hair to be treated.

Figure 2:
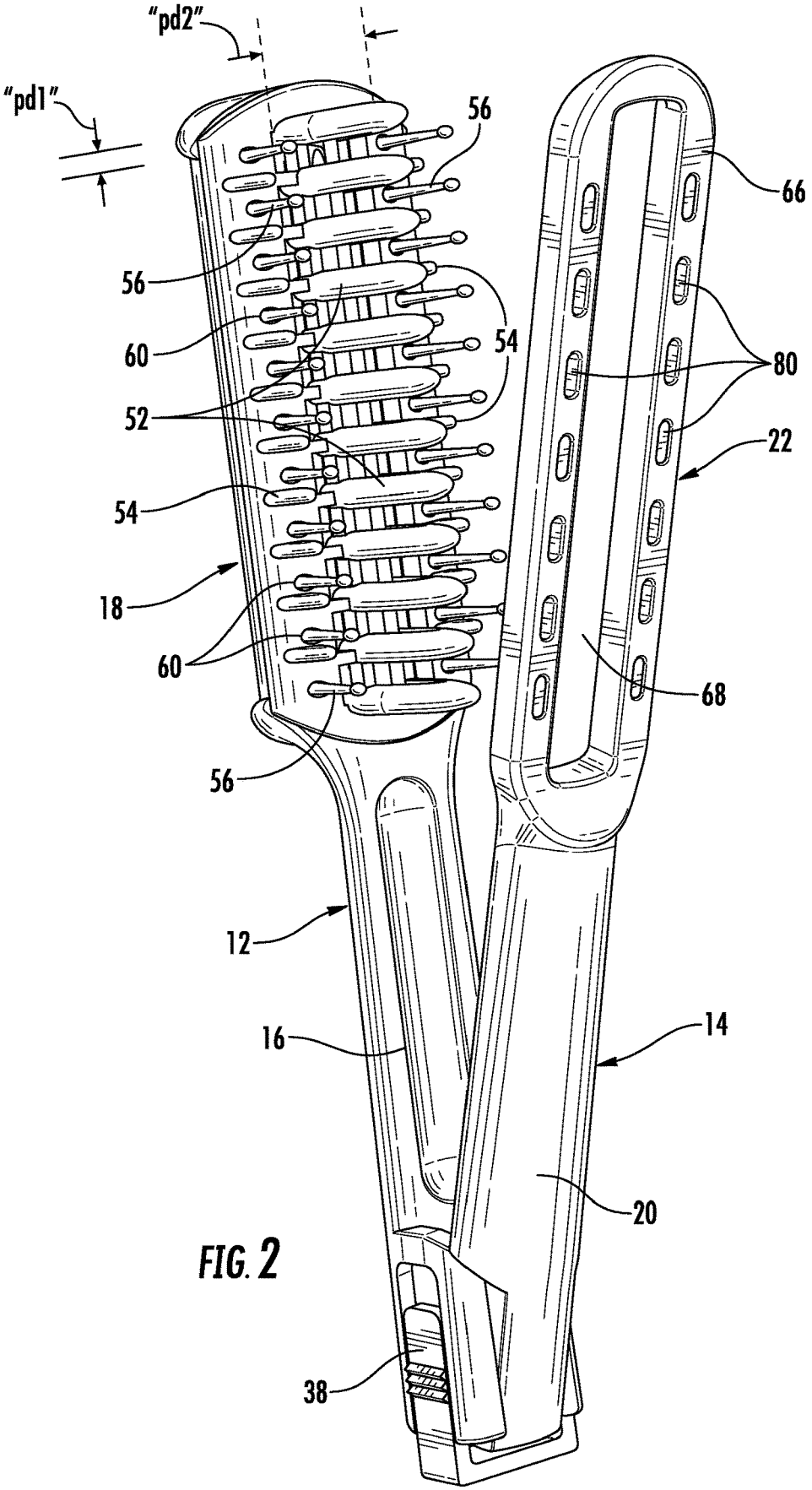
FIGS. 2-3 are perspective views of the hair bush illustrating the first and second members in an open condition.
Figure 3:
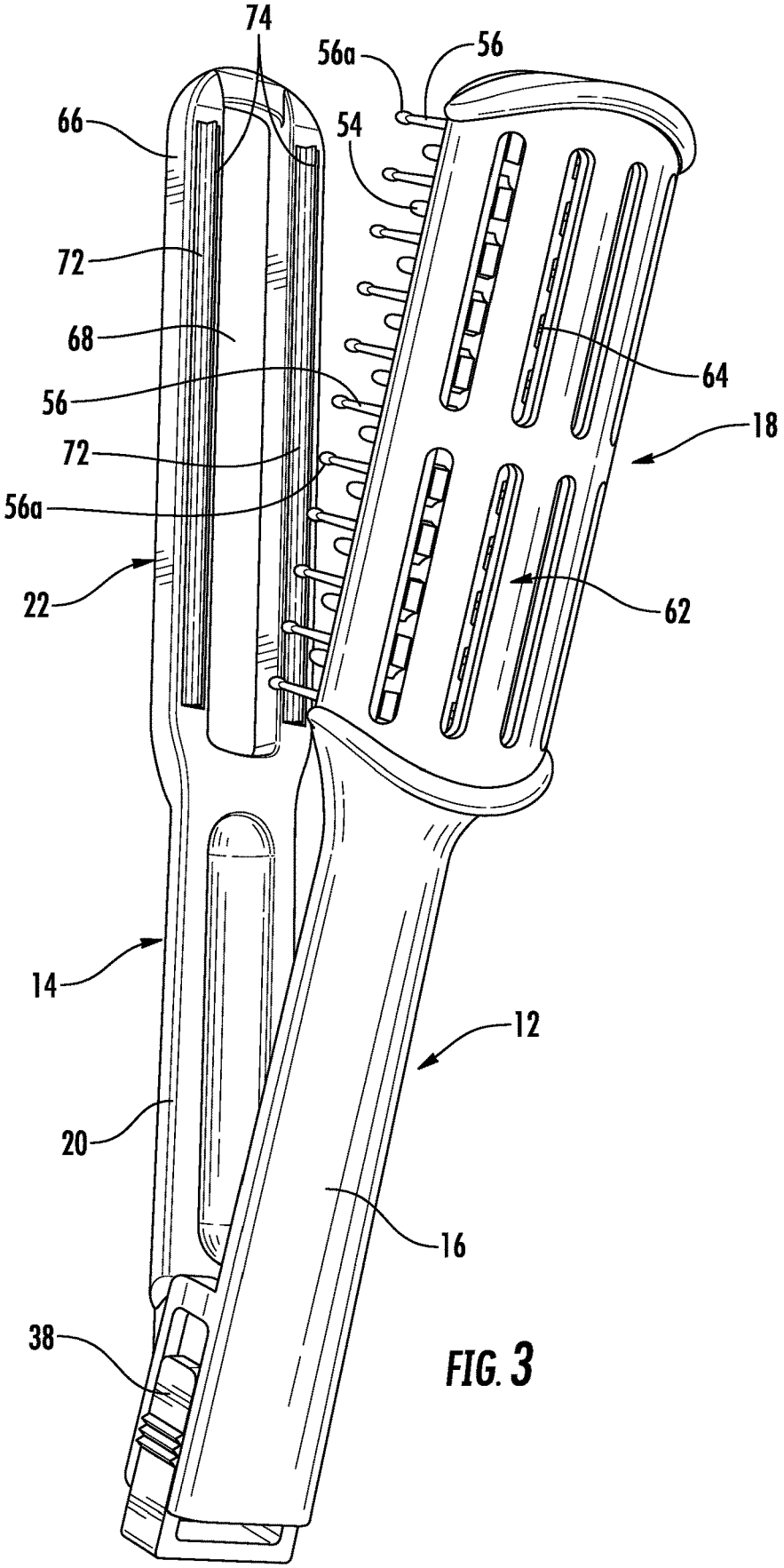
Figure 4:
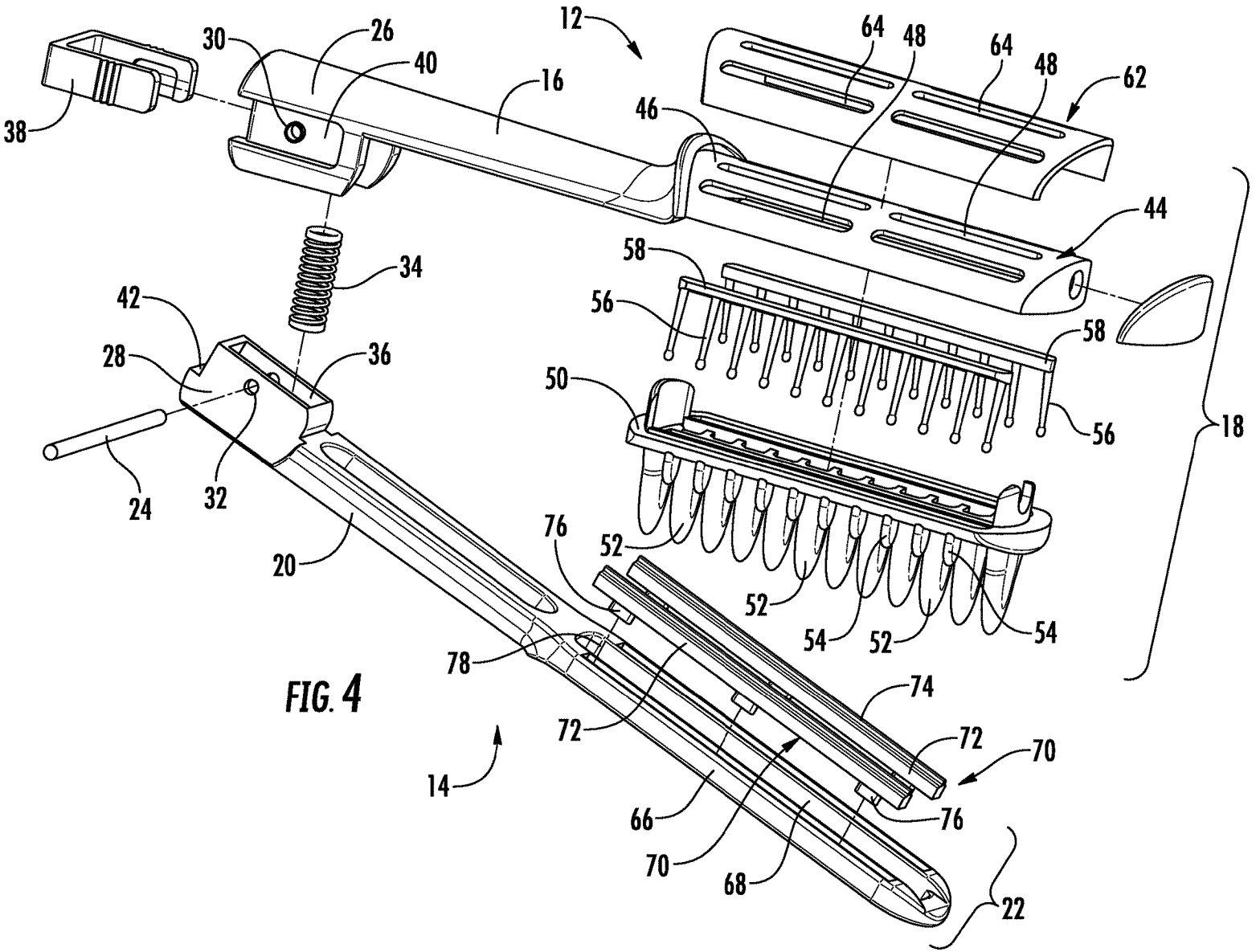
FIG. 4 is an exploded perspective view of the hair brush.

With reference to FIGS. 1-3, the hair brush 10 includes a first member 12 and a second member 14, and defines a longitudinal axis "k" extending along the length of the hair brush 10. The first member 12 includes a first handle 16 and a first brush head 18 extending from the first handle 16. Similarly, the second member 14 includes a second handle 20 and a second brush head 22 depending from the second handle 20. As best depicted in FIG. 4, the first and second members 12, 14 are coupled about a hinge or pivot member 24, and pivot between the approximated condition of FIG. 1 and the open condition of FIGS. 2-3. The first handle 16 of the first member 12 may include a U-shaped channel 26 which receives a box-shaped mount 28 of the second handle 20 with the pivot member 24 extending between corresponding openings 30, 32 of these components to pivotally couple the first and second members 12, 14. A spring 34 may normally bias the first and second members 12, 14 to the open condition. The spring 34 may be received within an internal chamber 36 defined by the mount 28 of the second member 14 and extend toward the first member 12 for reception within the U-shaped channel 26 forward of the pivot member 24. Other arrangements are also envisioned.

The first and second members 12, 14 may include a locking mechanism to releasably secure the first and second members 12, 14 in the approximated condition. The locking mechanism includes a lock 38 which is received within an outer locking recess 40 of the U-shaped channel 26 of the first member 12. The lock 38 traverses the locking recess 40 through manual manipulation of the user between a locked condition shown in FIG. 1 and the release position of FIGS. 2-3. In the locked position of the lock 38, the lock 38 engages an outer shelf 42 within the mount 28 of the second handle 20 preventing the first and second members 12, 14 from pivoting relative to each other and maintaining the first and second members 12, 14 in the approximated condition. (FIGS. 1 and 4)

With continued reference to FIG. 4, the first brush head 18 includes a first head frame 44, e.g., monolithically formed with the first handle 16. The first head frame 44 defines an outer surface 46 which is substantially rounded or arcuate. The first head frame 44 includes a plurality of vent openings 48 extending through the inner and outer surface of the first head frame 44 for conveying heat therethrough from, e.g., a hair dryer. The first brush head 18 includes a tooth support 50 which is mounted to the first head frame 44 through a snap fit arrangement or any other conventional means including, adhesives, cements, spot welding or the like. As best depicted in FIG. 4, in conjunction with FIGS. 1-2, the tooth support 50 includes an inner row of centrally disposed primary teeth 52 spaced along the central longitudinal axis "k" in general alignment therewith and depending toward the second member 14. The primary teeth 52 may be substantially triangular shaped when viewed in plan. As shown in FIG. 2, the primary teeth 52 each define a maximum dimension "pd1" along the longitudinal axis "k" and a maximum dimension "pd2" orthogonal to the longitudinal axis "k". In an embodiment, "pd2" is at least two (2) to three (3) times greater than "pd1" to define a tooth having an elongated dimension orthogonal to the central longitudinal axis "k". This elongated triangular-shape increases surface contact with the length of hair to facilitate separation of the length of hair into individual strand(s).

The tooth support 50 also includes a row of supplemental teeth 54 extending along the longitudinal axis "k" on each side of the centrally disposed primary teeth 52. The supplemental teeth 54 may be substantially triangular-shaped, but are smaller in dimension than the primary teeth 52. As shown in FIG. 1, the supplemental teeth 54 each define a maximum dimension "sd1" along the longitudinal axis "k" and a maximum dimension "sd2" orthogonal to the longitudinal axis "k" where "sd2" is at least two (2) to three (3) times greater than "sd1". The triangular shape of the supplemental teeth 54 also provides an elongated dimension orthogonal to the central longitudinal axis "k" to increase the surface contact with hair and facilitate the combing process. The tooth support 50, primary teeth 52 and supplemental teeth 54 may be monolithically formed as a single unit.

The first brush head 18 further includes an outer row of bristles 56 with rounded heads **56*a* extending along the longitudinal axis "k" on each side of the centrally disposed primary teeth 52. The rows of bristles 56 each may be mounted or monolithically formed with a bristle support 58 which is secured to the first head frame 44 beneath the tooth support 50. The individual bristles 56 extend through corresponding apertures 60 defined in the tooth support 50 (FIG. 2). In an embodiment, individual supplemental teeth 54 of the row of the supplemental teeth 54 are disposed between adjacent individual bristles 56 of the row of bristles 56 to define an alternating arrangement of bristles 56 and supplemental teeth 54 along the longitudinal axis "k". The alternating arrangement in combination with the primary teeth 52** facilitate the combing process by separating the strands of hair into either individual or a small finite number of strands.

With continued reference to FIGS. 3-4, the first brush head 18 further includes a conductive member 62 which is mounted to the outer arcuate surface 46 of the first head frame 44. The conductive member 62 includes a conductive metal such as aluminum or stainless steel. The conductive member 62 defines an arcuate or rounded configuration to impart a curling effect on hair engaged therewith. The conductive member 62 may include a plurality of vent openings 64 to convey heat through the first head frame 44, e.g., beneath the tooth support 50 during use with, e.g., a portable hand-held hair dryer or other heating element. The vent openings 64 may be similar in size to the vent openings 48 of the first head frame 44 and in alignment therewith. The conductive member 62 extends beyond the perimeter of the second brush head 22 when the first and second members 12, 14 are approximated, providing an enlarged profile to assist the curling process.

With reference to FIGS. 3-6, the second brush head 22 of the second member 14 includes a second head frame 66 which may be monolithically formed with the second handle 20. The second head frame 66 defines a longitudinal open channel 68 extending through the inner surface and the outer surfaces of the second head frame 66, and configured to at least partially receive or accommodate the centrally disposed primary teeth 52 of the first brush head 18 when the first and second members 12, 14 are in the approximated condition. (FIGS. 5 and 6) The second brush head 22 further includes a pair of elongate members 70 one on each side of the longitudinal open channel 68. The elongate members 70 each include a base 72 and an outwardly depending wiper segment 74. The base 72 may include mounting legs 76 which are received within corresponding mounting openings 78 of the second head frame 66 to mount the elongate members 70 relative to the second head frame 66.

Figure 6:
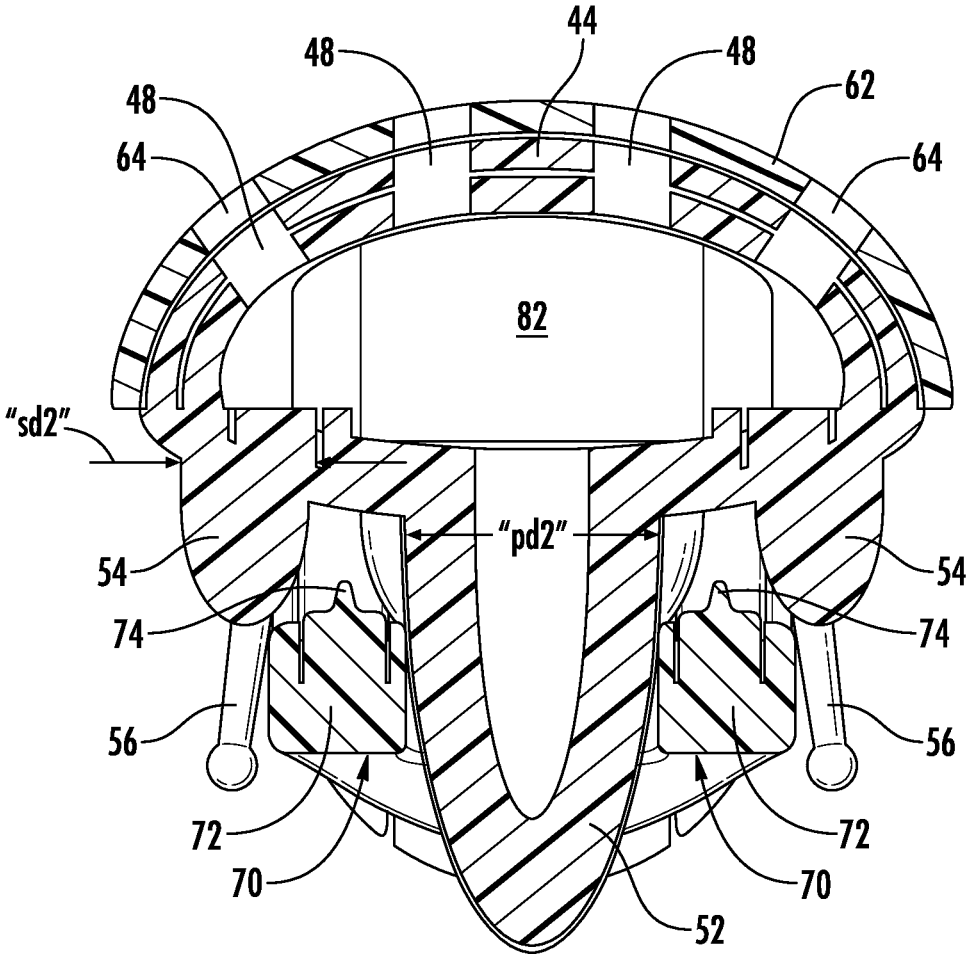
FIG. 6 is an enlarged cross-sectional view taken along the lines 6-6 of FIG. 5.

As best depicted in the cross-sectional view of FIG. 6, in conjunction with FIG. 3, the wiper segments 74 depend outwardly from the base 72. The wiper segments 74 are relatively flexible and capable of bending or distorting when engaging the length of hair disposed between the first and second brush heads 18, 22 to accommodate variations in the thickness of the length of hair. This flexible characteristic enhances engagement of the elongate members 70 with the entire width of the hair disposed between the first and second brush heads 18, 22 thereby facilitating the straightening process. The flexible nature of the wiper segments 74 may also facilitate distribution of the strands of hair through at least the primary and/or supplemental teeth 52, 54 of the first brush head 18. The wiper segments 74 may also function in removing water, moisture or oil from the head (in a similar manner to a squeegee). The elongate members 70 including the wiper segments 74 may or may not be formed of a heat conductive material. In one embodiment, the elongate members 70 are fabricated from an elastomer or a polymeric material.

Figure 5:
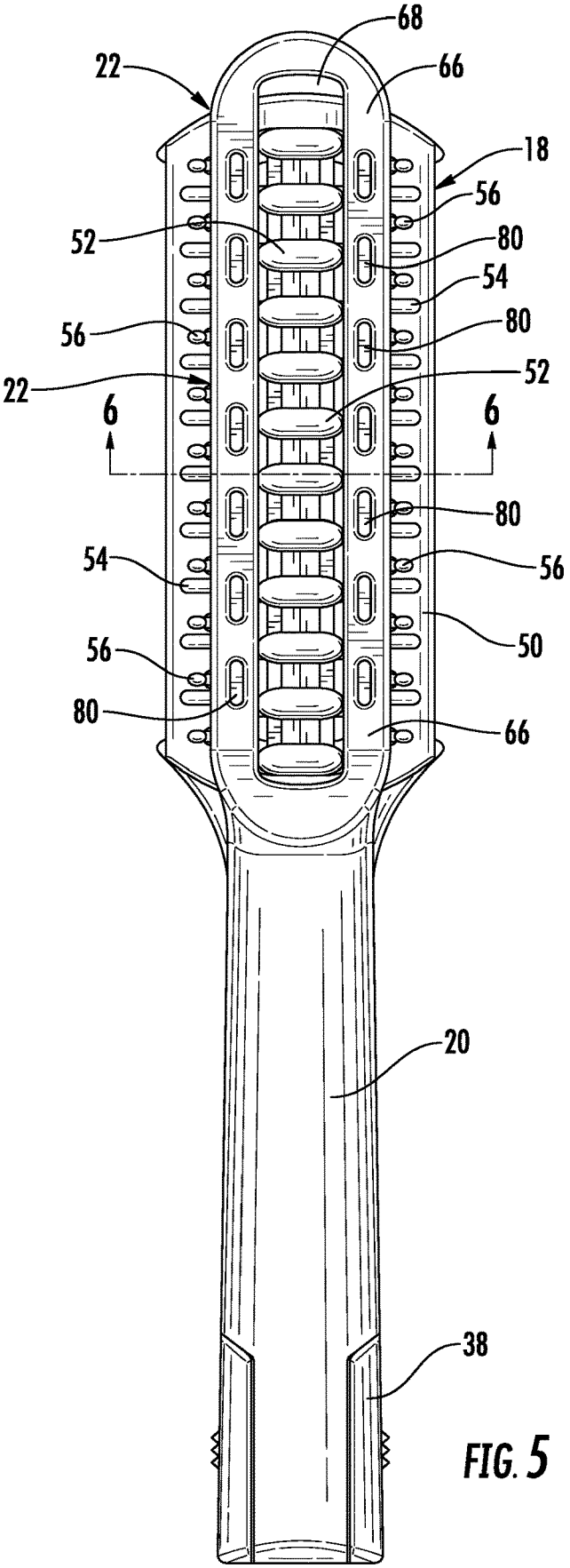
FIG. 5 is a top plan view of the hair brush in the closed condition.

As best depicted in FIGS. 1, 2 and 5, the second head frame 66 also includes a plurality of apertures 80 extending completely therethrough. The apertures 80 are configured to communicate thermal energy to the first and second brush heads 18, 22 to assist in the straightening and/or curling processes.

With reference again to FIG. 6, the first head frame 44 defines an internal chamber 82 disposed between the first head frame 44 and the tooth support 50. The internal chamber 82 is in fluid communication with the vent openings 48 of the first head frame 44 and the vent openings 64 of the conductive member 62. The internal chamber 82 may be adapted to store thermal energy conveyed from e.g., a hair dryer, to assist in heating the components of the hair brush 10 to facilitate styling of hair.

Figure 7:
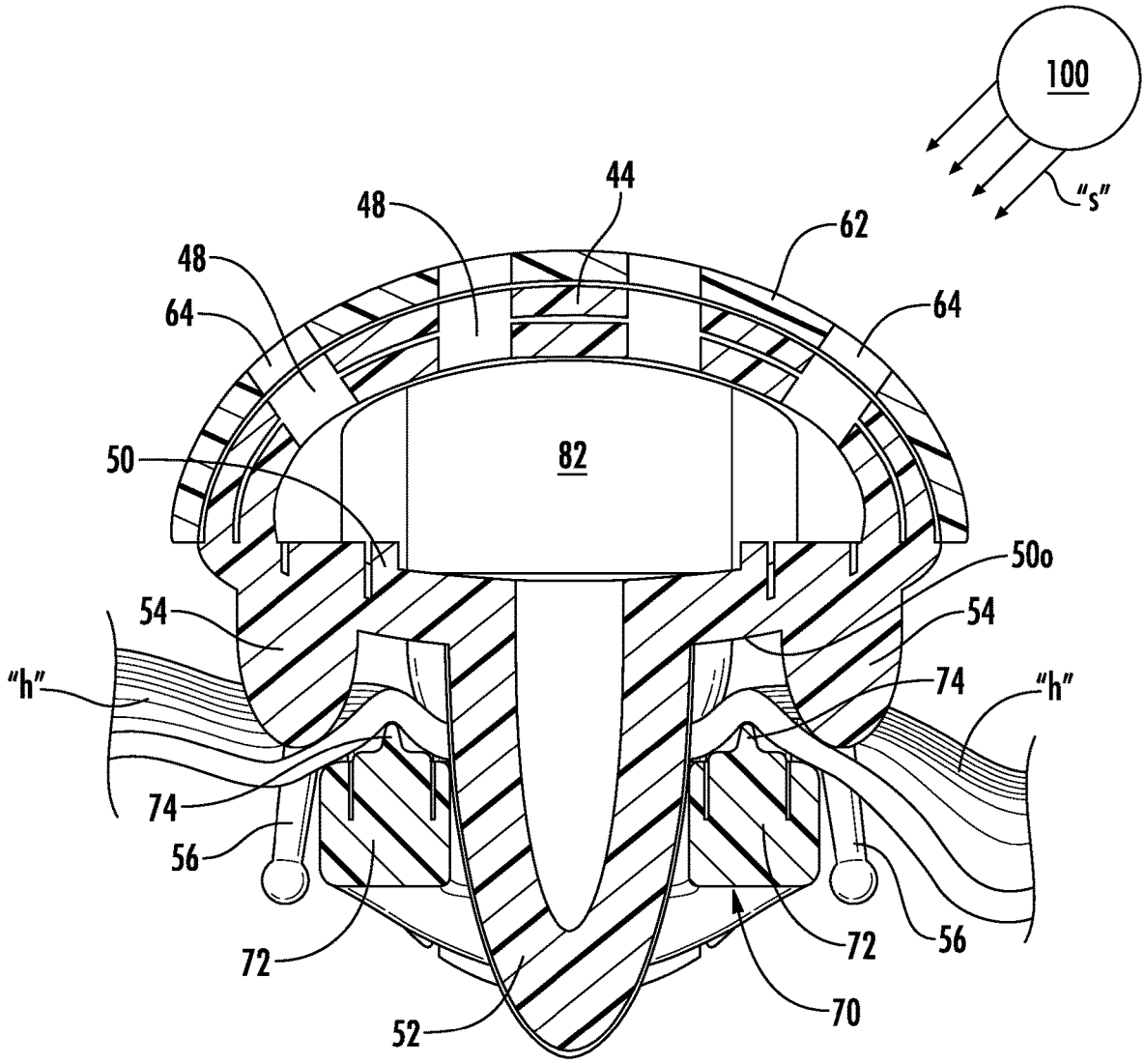
FIG. 7 is a cross-sectional view of the hair brush similar to the view of FIG. 6 with a length of hair disposed between first and second brush heads of the first and second members to impart a straightening effect on hair.

The use of the hair brush 10 will now be discussed. The first and second handles 16, 20 are grasped by the user and the lock 38 is moved to its release position of FIGS. 2 and 3 to permit the first and second members 12, 14 to assume the open condition under the influence of the spring 34. A length of hair "h" is positioned between the first and second brush heads 18, 22, and the first and second members 12, 14 are closed by the user squeezing the first and second handles 16, 20 towards each other. (FIG. 7) The first and second members 12, 14 may be secured in the approximated condition by moving the lock 38 to the locked position thereof. (FIG. 1) A portable hand held hair dryer, schematically illustrated as reference numeral 100, may be used to direct a heated air flow "s" toward the first and second brush heads 18, 22 while the hair brush 10 is being pulled through hair to separate the hair, via the primary teeth 52, supplemental teeth 54 and the bristles 56, into a small number of strands. The heat from the hair dryer 100 may be conveyed through the vent openings 64, 48 of the conductive member 62 and the first head frame 44 and through the apertures 80 of the second head frame 66. Thermal energy may be stored within the internal chamber 82 to also heat the components. The wiper segments 74 of the elongate members 70 engage the length of hair "h" and compress the length of hair "h" relative to the opposing surface of the first brush head 18 (e.g., the outer surface 50*o* of the tooth support 50) to assist in straightening the length of hair "h".

Figure 8:
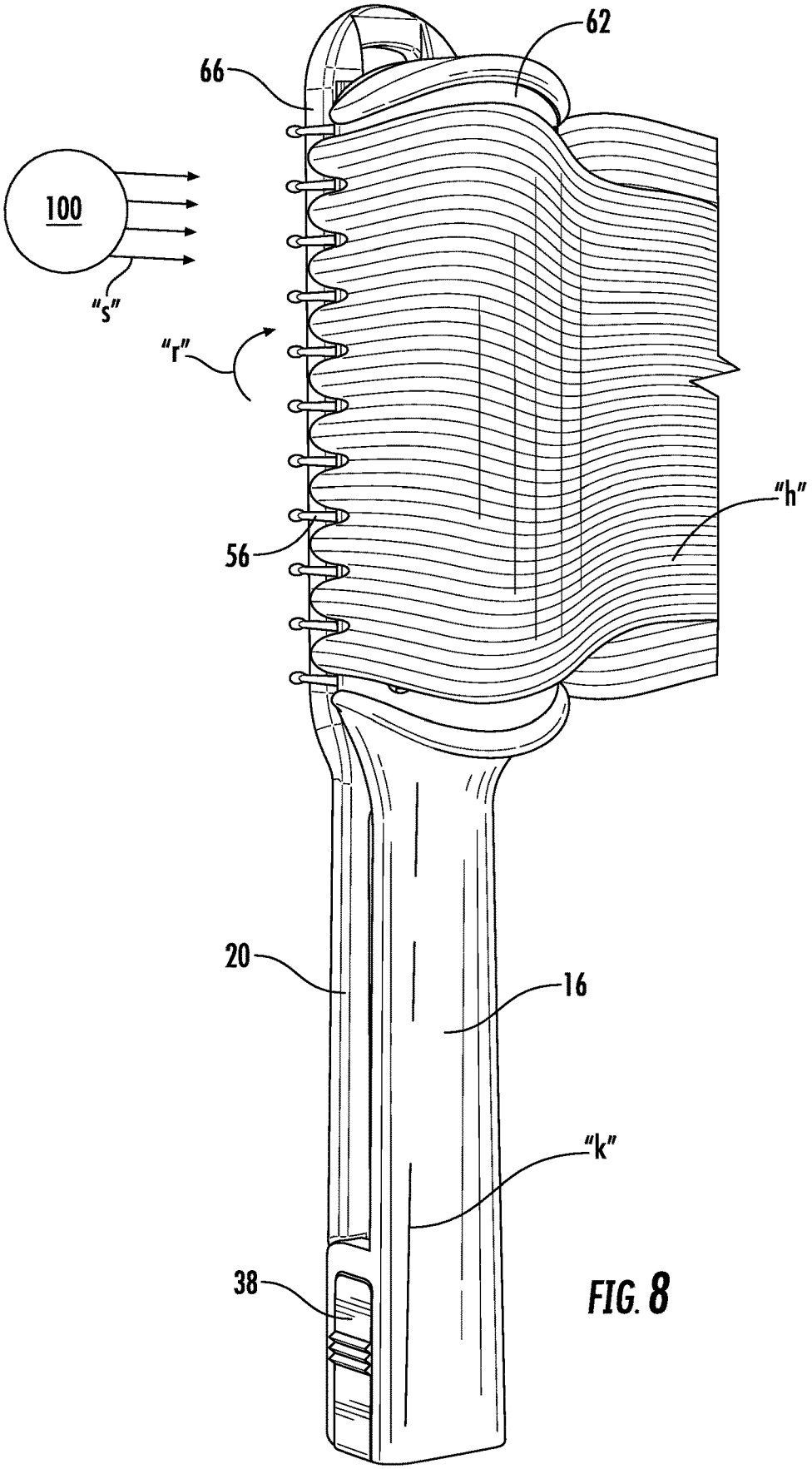
FIG. 8 is a view of the hair brush being rotated about the lock of hair whereby the conductive element on the first member imparts a curling effect on the length of hair.

As best depicted in FIG. 8, when it is desired to curl the length of the hair "h", the hair brush 10 is rotated about the longitudinal axis "k" in the direction of directional arrow "r" whereby the hair "h" contacts the conductive member 62 which is heated via the hair dryer to impart a wave or curl within the length of hair "h". The process may be repeated a number of times to straighten and/or curl hair as desired.

Although the illustrative embodiments of the present disclosure have been described herein with reference to the accompanying drawings, the above description, disclosure, and figures should not be construed as limiting, but merely as exemplifications of particular embodiments. For example, the first and second brush heads may be plated, coated, deposited or otherwise treated with substances such as ceramic, tourmaline, metals, glass, and/or various substances that retain heat, emit heat, emit ions, emit infrared energy, remove static, removed contaminants and perform other functions. It is to be understood, therefore, that the disclosure is not limited to those precise embodiments, and that various other changes and modifications may be effected therein by one skilled in the art without departing from the scope or spirit of the disclosure.

What is claimed is:

1. A hair brush, which comprises:

first and second members defining a longitudinal axis and configured for relative movement between open and approximated conditions, the first member including:

a first handle and a first brush head extending from the first handle, the first brush head having:

a first head frame;

an inner row of centrally disposed primary teeth mounted to the first head frame and extending along the longitudinal axis, the centrally disposed primary teeth each defining a first primary dimension along the longitudinal axis and a second primary dimension orthogonal to the longitudinal axis, the second primary dimension being greater than the first primary dimension;

a row of supplemental teeth extending along the longitudinal axis on each side of the centrally disposed primary teeth, the supplemental teeth each defining a first supplemental dimension along the longitudinal axis and a second supplemental dimension orthogonal to the longitudinal axis, the second supplemental dimension being greater than the first supplemental dimension;

an outer row of bristles mounted to the first head frame and extending along the longitudinal axis on each side of the centrally disposed primary teeth; and a thermal conductive element mounted to an outer surface of the first head frame, the thermal conductive element defining an arcuate surface configured for imparting a curl along a length of hair; and the second member including a second handle and a second brush head depending from the second handle, the second brush head having:

a second head frame defining an open longitudinal channel extending therethrough configured to receive the centrally disposed primary teeth of the first brush head when the first and second members are in the approximated condition; and an elongate member disposed on each side of the longitudinal channel, each elongate member having a wiper segment configured to engage the length of hair to impart a straightening effect on the length of hair or to remove substances from the length of hair when the first and second members are in the approximated condition;

wherein the outer rows of bristles are disposed outwardly of respective longitudinal sides of the second brush head when the first and second members are in the approximated condition; and wherein individual teeth of respective rows of the supplemental teeth are disposed between adjacent individual bristles of respective rows of bristles to define an alternating arrangement of bristles and supplemental teeth along the longitudinal axis.

2. The hair brush according to claim 1 wherein the wiper segment of each elongate member is flexible to conform to the length of hair disposed between the first and second brush heads.

3. The hair brush according to claim 1 wherein the outer rows of bristles are disposed outwardly on respective longitudinal sides of the second brush head when the first and second members are in the approximated condition.

4. The hair brush according to claim 1 wherein the thermal conductive element comprises a metallic material.

5. The hair brush according to claim 1 wherein the first and second members are configured for pivotal movement between the open and approximated conditions.

6. The hair brush according to claim 5 wherein the first and second members are normally biased toward the open condition by a spring member.

7. The hair brush according to claim 6 including a lock mounted relative to the first and second members, the lock movable between a locked position to retain the first and second members in the approximated condition and a release position permitting movement of the first and second members toward the open condition under the influence of the spring member.

8. The hair brush according to claim 1 wherein the first head frame and the thermal conductive member include respective vent openings.

9. The hair brush according to claim 8 wherein the first head frame defines an internal chamber in fluid communication with the vent openings.

10. The hair brush according to claim 1 wherein:

the primary teeth each define a first height;

the supplemental teeth each define a second height; and the outer bristles each define a third height;

wherein the first height is greater than the second height and the third height.

11. The hair rush according to claim 10 wherein the third height is greater than the second height.

12. The hair brush according to claim 1 wherein individual bristles of the outer rows of bristles are longitudinally offset with respect to individual teeth of the primary teeth.

13. The hair brush according to claim 1 wherein at least portions of the individual teeth of the respective rows of the supplemental teeth are disposed outwardly of respective longitudinal sides of the second brush head when the first and second members are in the approximated condition.

* * * * *